US005802183A

United States Patent [19]

Scheller et al.

[11] Patent Number: 5,802,183

[45] Date of Patent: *Sep. 1, 1998

[54] BTE ASSISTIVE LISTENING RECEIVER WITH INTERCHANGEABLE CRYSTALS

[75] Inventors: Tom Scheller, Fridley; Scott Posner, Eden Prairie; Art Johnson, Lakeville; Pat Henry, Eagan; Irene Teske, Farmington, all of Minn.; Mark A. Gilbertson, Sauk City, Wis.

[73] Assignee: Telex Communications, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 567,942

[22] Filed: Dec. 6, 1995

[51] Int. Cl.[6] ..... H04R 25/00

[52] U.S. Cl. ..... 381/69; 381/682

[58] Field of Search ..... 381/68–69.2; 455/318, 455/319

[56] References Cited

U.S. PATENT DOCUMENTS

| | | | |
|---|---|---|---|
| 3,601,550 | 8/1971 | Spracklen . | |
| 3,612,749 | 10/1971 | Grube, Jr. et al. | 174/98 |
| 3,659,056 | 4/1972 | Morrison et al. . | |
| 3,668,334 | 6/1972 | Schwake . | |
| 3,742,359 | 6/1973 | Behymer | 381/69 |
| 3,826,987 | 7/1974 | Stevens . | |
| 4,061,972 | 12/1977 | Burgess . | |
| 4,334,315 | 6/1982 | Ono et al. | 455/11 |
| 4,472,603 | 9/1984 | Berg . | |
| 4,638,125 | 1/1987 | Buettner | 381/68.4 |
| 5,289,543 | 2/1994 | Leibman | 381/7 |

*Primary Examiner*—Curtis A. Kuntz
*Assistant Examiner*—Ping W. Lee
*Attorney, Agent, or Firm*—Fredrikson & Byron, P.A.

[57] ABSTRACT

A behind-the-ear assistive listening receiver having a housing containing an RF receiver. The housing includes a cavity in which two or more crystal carriers are removably insertable. Each of the crystal carriers contains an oscillation crystal tuned to a particular frequency corresponding to an RF frequency desired to be received by the user. A switch is provided for permitting the user to select one of the oscillation crystals to automatically tune for the RF receiver to the desired RF frequency. Each crystal carrier may contain visible indicia indicating the frequency to which it is tuned, and the carriers may be positioned in the housing so that the indicia are generally visible to others when the receiver is worn by the user. The assistive listening receiver may also include a conventional hearing aid microphone for converting ambient sounds into an electrical hearing aid signal. A mixer is provided within the housing for mixing the hearing aid signal with the RF signal to provide a mixed output signal. The mixer attenuates the maximum hearing aid signal with respect to the maximum RF signal by about 1 to 10 decibels so that the maximum RF signal will be perceptibly louder to the user than the maximum hearing aid signal.

19 Claims, 8 Drawing Sheets

BTE ASSISTIVE LISTENING RECEIVER WITH INTERCHANGEABLE CRYSTALS

TECHNICAL FIELD

The invention relates to wireless behind-the-ear assistive listening receivers of the type worn by hearing impaired persons to receive RF transmissions (typically FM transmissions) in classrooms and other similar settings.

BACKGROUND OF THE INVENTION

Wireless assistive listening systems are used in a variety of environments to aid persons with impaired hearing. A common setting for the use of such devices is in the classroom. An instructor may wear a microphone (desirably wireless) and associated transmitter, the signal from which is broadcast on a low power FM frequency within the classroom (typically, e.g., in the 72–76 MHz band). An FM receiver (desirably battery powered) may be worn by a student and connected to headphones, a button-type earphone or a suitable behind-the-ear (BTE) carrier of a speaker. The FM receiver demodulates the FM transmission and provides it directly to the hearing device.

In many such commercially available assistive listening systems the FM receiver worn by the student is pre-tuned to the FM frequency at which the signal is broadcast. Such pre-tuning eliminates the need for the student to tune the receiver to the relevant channel—this task can be difficult for some students, particularly, e.g., very young students or students who have additional physical or mental challenges. Such pre-tuning also eliminates the need for additional manual tuning components built into the receiver.

Though pre-tuning of the receiver provides the above advantages, it also presents some disadvantages. If multiple classrooms within a building utilize assistive listening systems, usually it is necessary that they broadcast on different frequencies so as to avoid interference with one another (i.e., so the student only receives a signal from the teacher in his or her classroom, not from teachers in other classrooms in the building). This requires students in each classroom to utilize receivers which are pre-tuned to the frequency of the classroom to which they are assigned. If a student changes classes (e.g., either during the day or from one quarter to the next), the receiver must also be changed. Since hearing impaired students often meet regularly with specialists (such as speech therapists) during the class day, students frequently must change receivers when they meet with such specialists.

U.S. Pat. No. 3,668,334 discloses a hearing aid device which provides for the convenient exchange of receivers for students when they switch classes. The device includes a housing, which may be strapped to the child's chest or clipped in a shirt pocket, the housing containing a microphone and an amplifier with associated electrical circuitry for a hearing aid. An earpiece is connected by wires to the rather bulky housing. The device includes a removable/replaceable battery pack designed to be received in the housing, the battery pack optionally containing an FM receiver pre-tuned to a particular frequency. When a child leaves a particular classroom to go to another classroom, the battery pack/FM receiver can be removed from the housing and a different battery pack with an FM receiver tuned to a different FM frequency (or a battery pack with no FM receiver) can be inserted into the housing. This arrangement solves some of the problems associated with switching classes, but presents a rather bulky solution—substantially the entire receiver unit is replaced every time the child switches rooms. Moreover, because the unit is pre-tuned to a single frequency, every time the child changes rooms the battery pack/receiver unit must also be changed.

SUMMARY OF THE INVENTION

The invention provides a behind-the-ear assistive listening receiver that solves the above-mentioned problems. The device includes a housing having a size and shape adapted to fit behind the outer ear of a user. The housing includes an opening into which two or more crystal carriers are removably received. Each such crystal carrier contains an oscillation crystal tuned to a particular frequency corresponding to an RF frequency desired to be received by the user. An RF receiver contained in the housing receives the RF transmissions on the frequency desired to be heard by the user. A switch or similar means is provided to permit the user to select which of the two the oscillation crystals is utilized by the RF receiver, thus permitting the user to receive the desired RF transmissions on the desired RF frequency. With two crystal carriers installed in the device, a student may regularly alternate between two rooms (e.g., a home room and a hearing specialist's room) without having to remove or replace the crystals. The crystal carriers are easily changed by the user, however, if the user desires to listen to a third frequency or if, e.g., the child changes home rooms.

In a preferred embodiment, each crystal carrier includes outwardly visible indicia corresponding to the frequency to which such crystal is tuned, and the crystals are carried by the housing in an orientation such that the outwardly visible indicia are visible to others when the receiver is worn by the user. Thus, a teacher can easily visually confirm that a student has the proper crystal installed in the device without removing it from the student's ear. The outwardly visible indicia may comprise a number corresponding to a particular frequency or channel, or may be other easily recognizable indicia such as a color or combination of colors.

Preferably the assistive listening receiver also includes a conventional hearing aid microphone carried by the housing for converting ambient sounds into an electrical hearing aid signal. A mixer is provided within the housing for mixing the hearing aid signal with the RF signal received by the RF receiver to provide a mixed output signal to the device's electro-acoustic transducer. In a preferred embodiment the mixer attenuates the maximum hearing aid signal with respect to the maximum RF signal—typically by about 1 to 10 decibels and preferably by about 3 to 6 decibels—so that the maximum RF signal will be perceptibly louder to the user than the maximum hearing aid signal. This allows the student to listen to ambient sound while assuring that such local sound will not drown out the teacher's RF signal (at least so long as the teacher is speaking up). Preferably the assistive listening receiver is provided with a selector or "mode" switch enabling the student to select among three modes of operation: just the hearing aid signal, just the RF signal, or the mixed output signal (with the maximum hearing aid signal volume being attenuated).

DETAILED DESCRIPTION OF THE INVENTION

Figure 1:
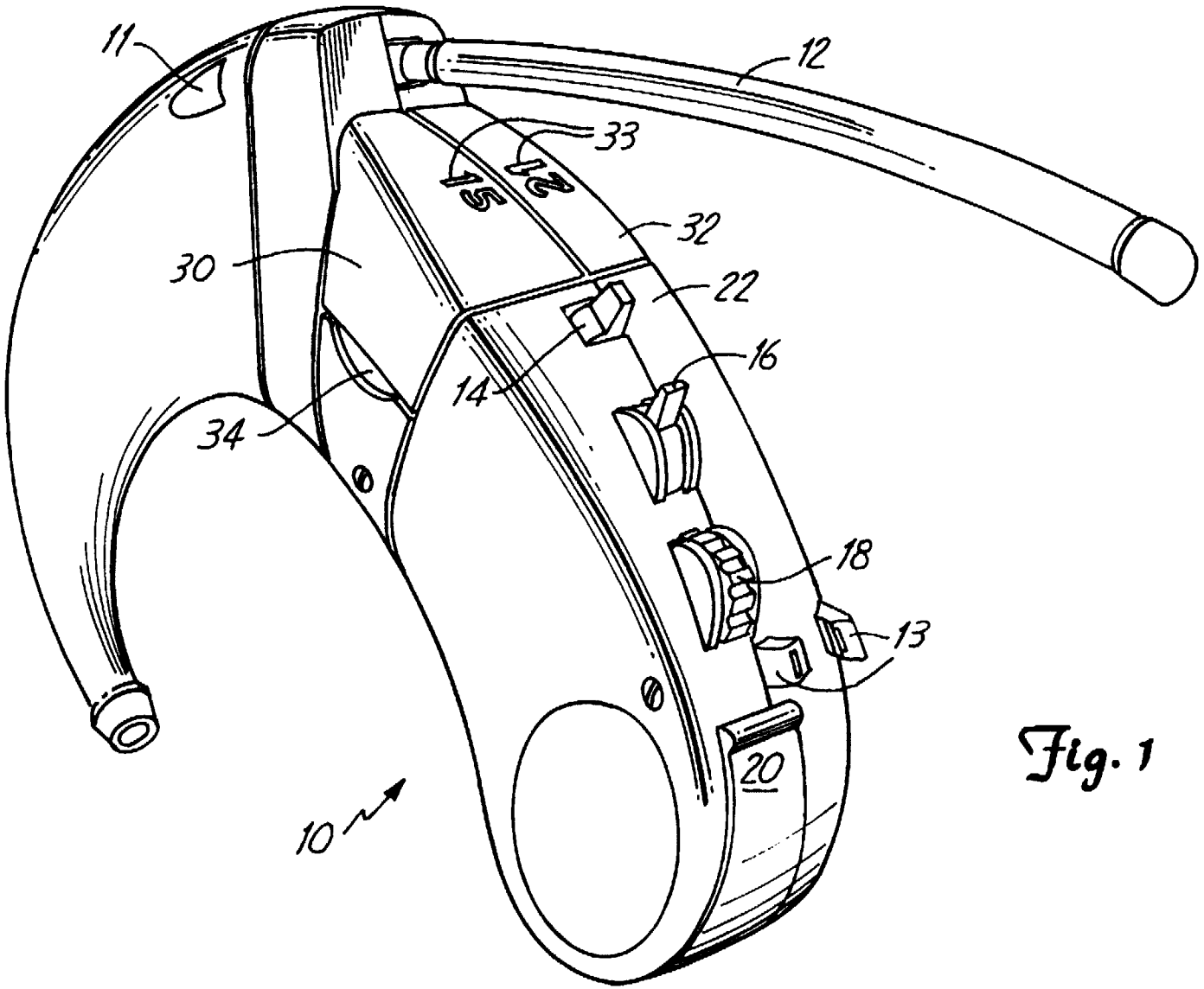
FIG. 1 is a perspective view of a BTE assistive listening receiver of the invention.

Referring to FIG. 1, a behind-the-ear (BTE) assistive listening receiver has a housing 10 of a size and shape adapted to fit behind the outer ear of a user, who may be either a child or an adult. The housing includes a port 11 behind which may be mounted a standard hearing aid microphone, a battery door 20 which may be opened to provide access for changing the device's standard hearing aid battery, and a gain control 18 enabling the user to adjust the volume of sound produced at the unit's electro-acoustic transducer.

The BTE assistive listening receiver of the invention includes an RF receiver for receiving and demodulating RF transmissions desired to be heard by the user. As indicated above, in most applications the RF signal is broadcast on a low power FM frequency within the classroom or auditorium (typically, e.g., in the 72–76 Mhz band). To facilitate the reception of such FM signals, an antenna, such as element 12 depicted in FIG. 1, may be incorporated in the BTE unit. Desirably the antenna 12 is made from flexible materials, making it less susceptible to damage and permitting it to be stored, when not in use, by bending it down against the radially outwardly facing surface 22 of the housing 10, where it may be secured by clip 13.

Figure 3:
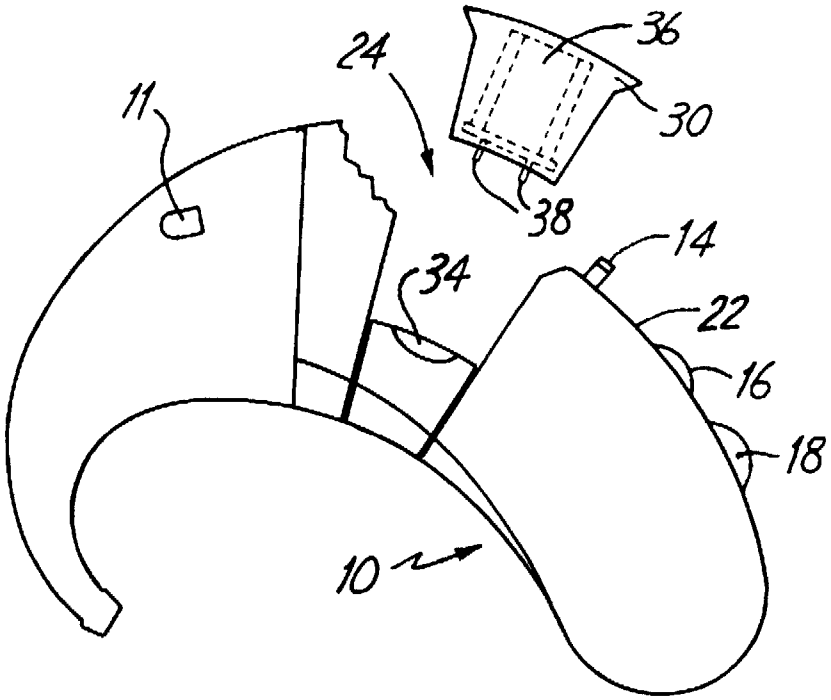
FIG. 3 is a side view similar to FIG. 2 with the crystal carriers removed.
Figure 2:
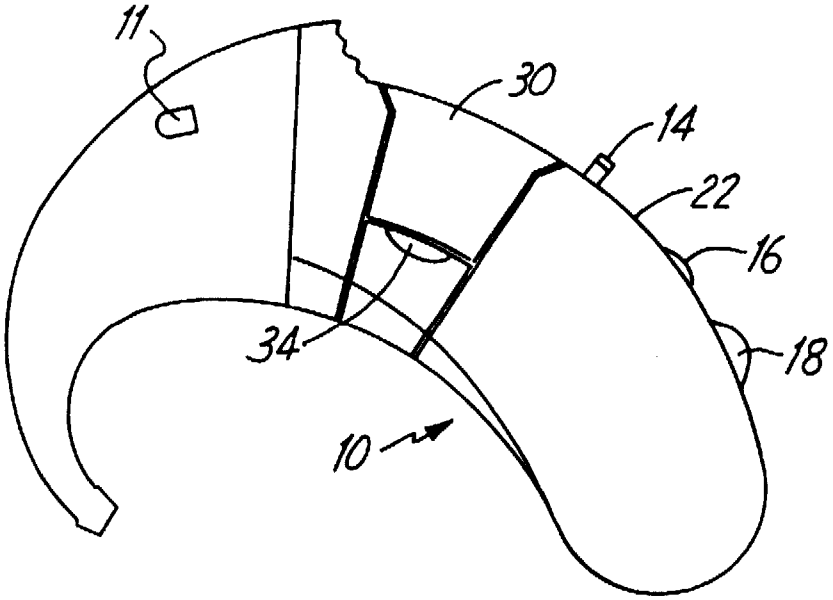
FIG. 2 is a side view of the receiver of FIG. 1 with the antenna details removed for the sake of clarity.

In the preferred embodiment shown in FIGS. 1–3, a pair of crystal carriers 30 and 32 are secured to the housing 10. Although any of a variety of shapes of crystal carriers and complementary mounting sections of the housing 10 may be employed, in the preferred embodiment depicted in the drawings the housing 10 contains a cavity 24 which is radially outwardly open, the crystal carriers 30 and 32 being of a size and shape that they fit snugly within the cavity 24. The cavity in the housing can be of any of a variety of shapes or configurations. Due to the size of the various components, and the desirability for ease of removal and replacing of the crystal carriers 30 and 32, preferably the cavity extends entirely across the radially outwardly facing surface 22 of the housing 10. Thus, when the crystal carriers 30 and 32 are installed, the radially outwardly facing surface of each crystal carrier is generally flush with the adjacent radially outwardly facing surface 22 of the housing 10. Such radially outwardly facing surfaces of the crystal carriers in effect partially define the outer surface of the unit. Moreover, in this embodiment, the cavity opening extends down the each lateral side of the housing, and the outward lateral sides of the crystal carriers are generally flush with the adjacent lateral sides of the housing. A depression 34 may be provided in the housing adjacent to an edge of each crystal carrier, permitting use of one's fingernail to assist in removing the crystal carrier when the user desires to replace the carrier with a crystal tuned to a different frequency. In this way, the crystal carriers may be changed entirely by hand, without requiring the use of any tools.

The preferred location of the installed crystal carriers 30 and 32 depicted in the drawings makes at least a substantial portion (i.e., the radially outwardly facing surface) of the carriers generally visible to others when the receiver is worn by the user (at least when the user's hair, hat, or other clothing does not cover the unit). Outwardly visible indicia may be placed on each crystal carrier corresponding to the frequency to which the crystal is tuned. Such indicia enables a teacher (or other person) to visually confirm, without removing the unit from the student's ear, that the student has the proper crystal installed for reception of the FM frequency on which the teacher is transmitting. In the unit depicted in FIG. 1, the indicia utilized are simply numbers 33 (in this case, the numbers "15" and "21", arbitrarily selected) molded or printed on the radially outwardly facing surfaces of the crystal carriers. The numbers may, for example, correspond to channel numbers utilized by associated broadcast equipment. Alternately (or additionally), color codes or any other suitable indicia may be utilized.

In the unit depicted in the drawings, two crystal carriers, providing two RF channels, are utilized. It will be understood that, subject to size and other physical constraints, more than two crystal carriers might also be utilized. Applicant has found, however, that providing two crystals (and therefore two RF channels) in the unit gives the user substantial advantages over a single RF channel without the need for more than two; many students routinely switch from one channel to another when they leave their home room to visit a specialist, but their need for three channels is less common. In situations where utilization of three or more channels is required, however, one or both of the crystal carriers may be relatively easily removed and replaced with a crystal carrier containing a crystal of the desired frequency.

Although the preferred unit depicted in the drawings shows both crystal carriers as being removable, the unit could also be constructed with a fixed crystal permanently installed, and one or more removable crystal carriers. Other suitable variations could also be utilized.

As can be seen in FIG. 1, a selector switch 14 is provided for allowing the user to select which one of the crystals (and, therefore, which RF frequency) will be utilized by the RF receiver contained in the unit.

Figure 4:
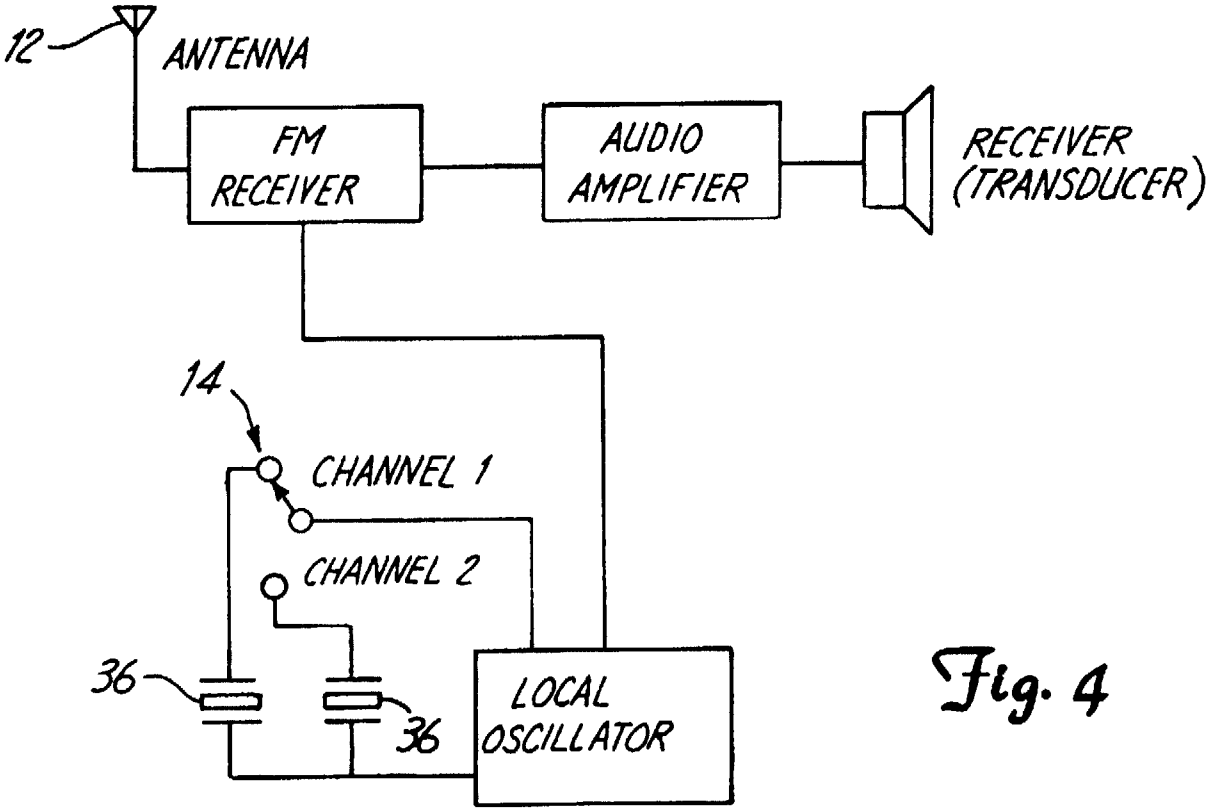
FIG. 4 is a block diagram depiction of the signal processing circuitry of a BTE assistive listening receiver of the invention.

FIG. 4 depicts in block diagram a signal processing circuit usable in the BTE assistive listening receiver of the invention. Switch 14 may be moved to one of two positions ("Channel 1" or "Channel 2") to select one of two crystals 36 to be utilized by the local oscillator, the oscillation signal from which is used by the FM receiver to demodulate transmissions received on the selected frequency by the antenna 12. The demodulated signal is passed on to a conventional hearing aid audio amplifier which is connected to a conventional electro-acoustic transducer (in hearing aid parlance, often called the "receiver" or "earphone") which converts the signal to audible sound provided to the user's ear (typically through a custom molded earpiece not shown in the drawings).

Figure 6:
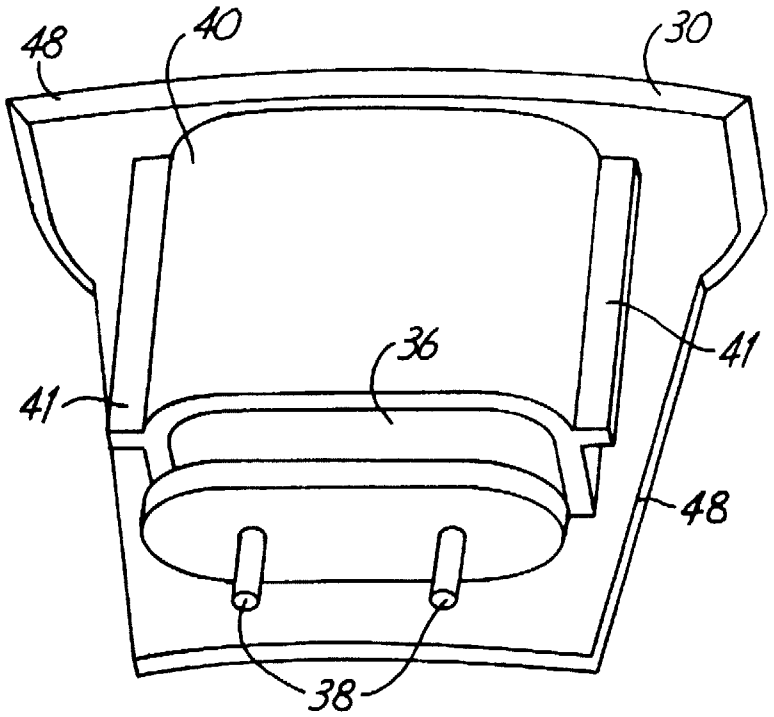
FIGS. 5 and 6 are perspective views from two slightly different angles of a crystal carrier insertable in a BTE assistive listening receiver of the invention.
Figure 5:
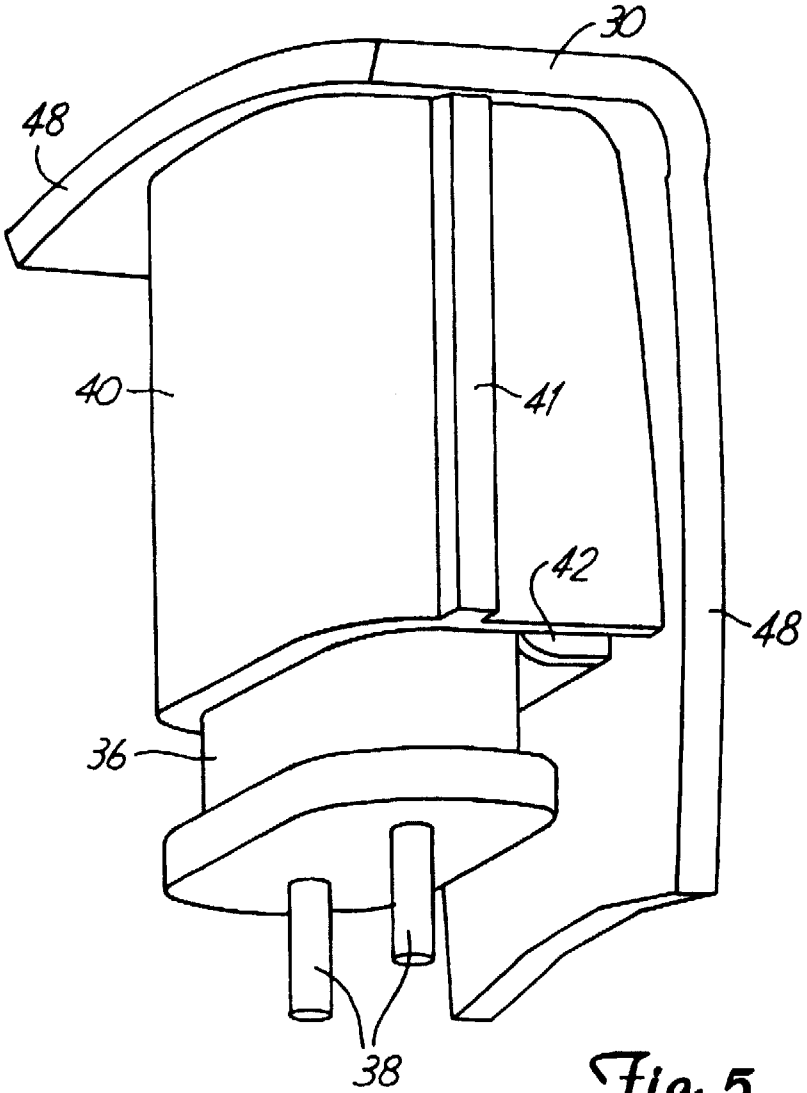

FIGS. 5–6 show enlarged details of a crystal carrier 30 of the invention. The carrier may simply be molded out of suitable plastic material, and contains a sleeve 40 into which a commercially available crystal canister 36 may be inserted. Ribs 42 may be provided on the inside of the sleeve 40 to form an interference fit with the canister 36, thereby snugly retaining the canister within the carrier 30.

Figure 7:
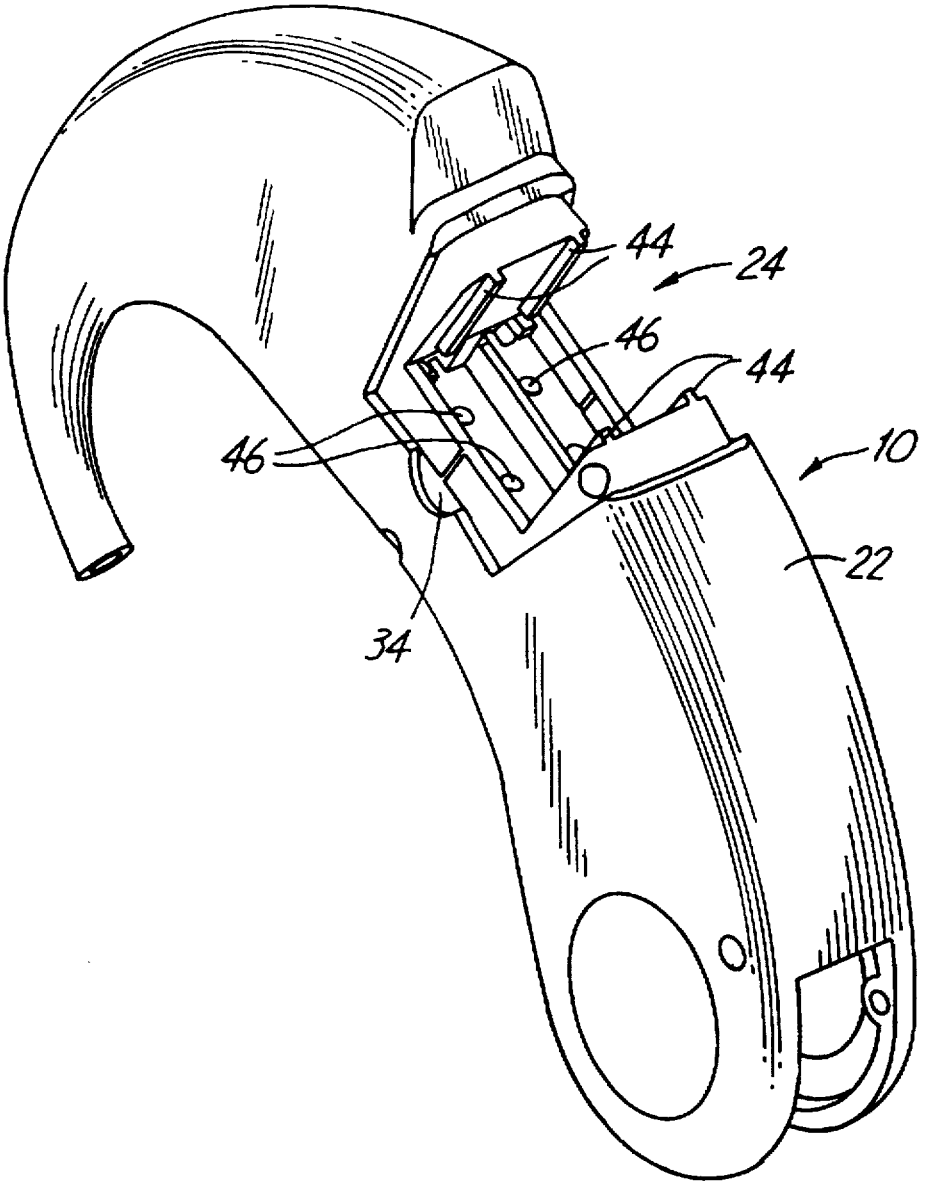
FIG. 7 is a perspective view of the housing of a BTE assistive listening receiver into which removable crystal carriers may be inserted.
Figure 8:
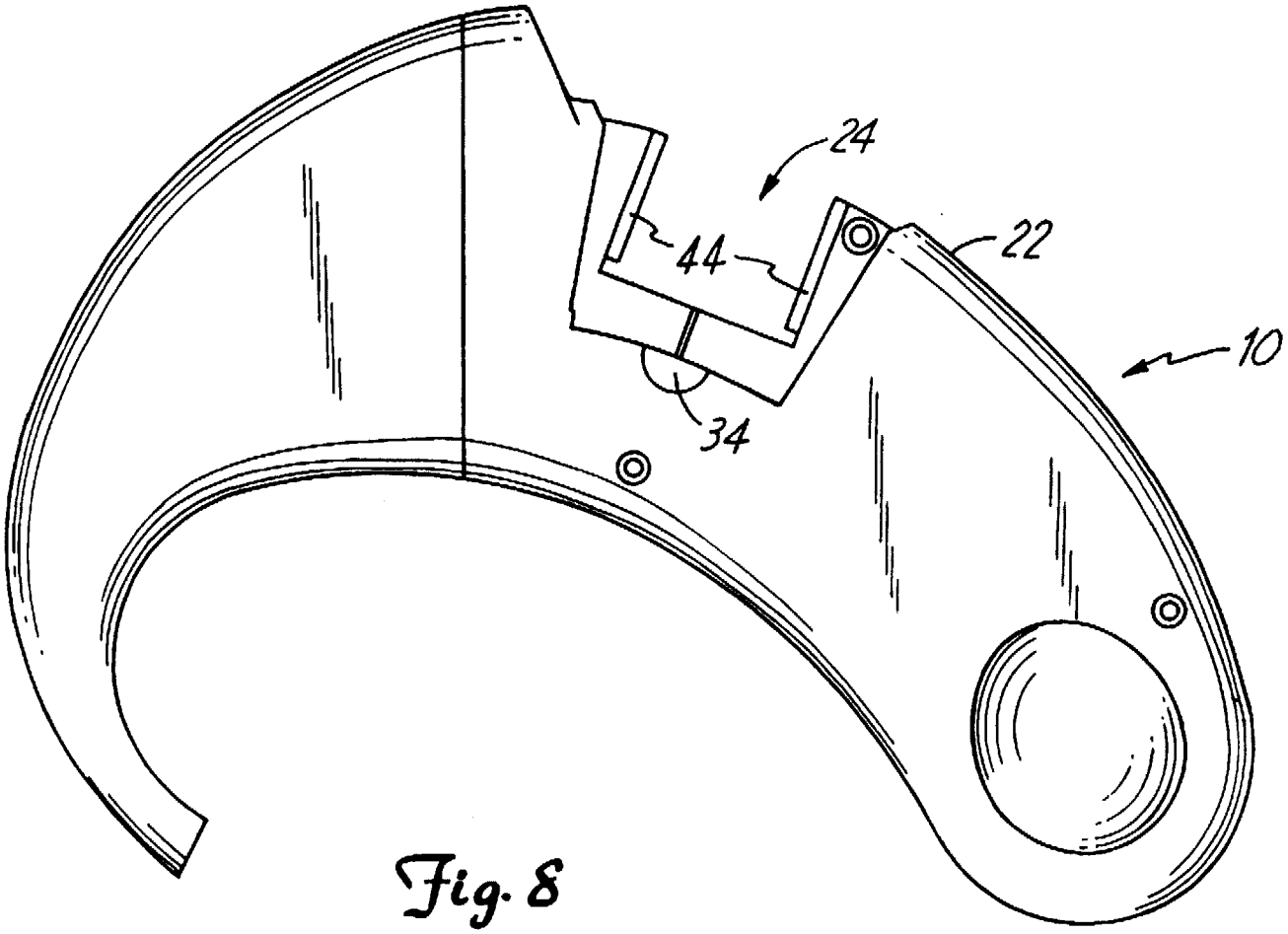
FIG. 8 is a side view of the receiver of FIG. 7.
Figure 9:
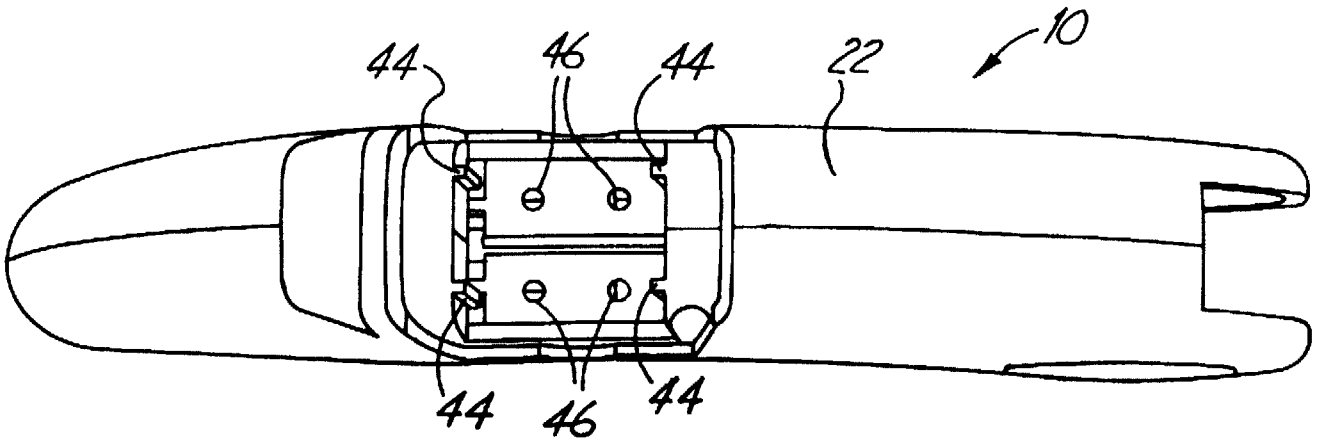
FIG. 9 is a top view of the receiver of FIG. 7.

A variety of complementary mechanical configurations may be utilized for mounting the crystal carrier 30 to the housing 10. The carrier shown in FIGS. 5 and 6 includes a pair of rails 41 on opposite sides of the sleeve 40 for engagement with corresponding shoulders 44 in the housing cavity (see FIGS. 7–9—note that most of the external controls and certain features of the housing are not shown in these drawings for purposes of clarity). An external flange 48 is provided in a shape and size so as to mate with adjacent portions of the housing 10, so that, when installed, the outer surface of the crystal carrier 30 is flush with the adjacent outer surface of the housing. This flush fit is not critical to utilization of the invention, but provides desirable aesthetics, and can be utilized to assist in proper positioning and securing of the carrier 30 to the housing 10.

Electrical contact between the crystal canister 36 and signal processing circuitry contained in the housing may be provided in any suitable manner. In FIGS. 5–9, the electrical leads 38 of the commercially available crystal canister 36 are received in complementary sockets 46 contained in the housing, the sockets being at least partially lined with suitable electrically conductive material. Other detachable connections may also be utilized, such as spring contacts mounted in the housing and biased toward corresponding conductive pads carried by the crystal carrier.

Figure 10:
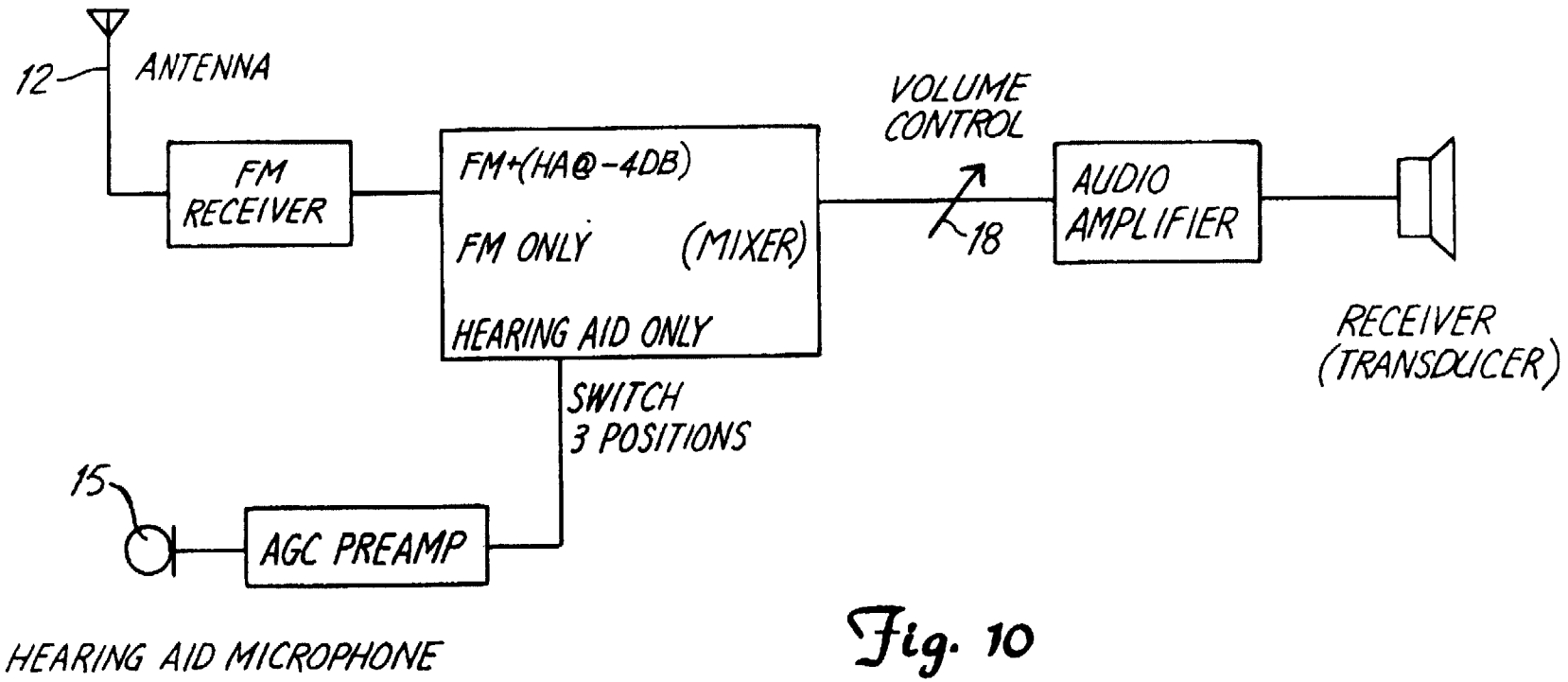
FIG. 10 is a block diagram depiction of the signal processing circuitry of a BTE assistive listening receiver of the invention with optional FM override.

FIG. 10 depicts a particularly preferred embodiment wherein the assistive listening receiver of the invention also includes a conventional hearing aid microphone 15, the RF signal received by the antenna 12 (identified in the drawing as being an FM signal) being combined with the hearing aid microphone signal so that the user receives both signals simultaneously. In normal operation, the effective gain provided by the RF signal typically is larger than the gain provided by the hearing aid signal, particularly in quiet environments. In some circumstances, however, ambient noise close to the user can be very loud so that the user has a difficult time hearing the RF signal. In the embodiment depicted in FIG. 10, the assistive listening device is provided with signal processing means which reduces the maximum loudness of the hearing aid signal to a level discernably less than the maximum loudness of the RF signal. The two signals are then mixed, amplified, and provided to the electro-acoustic transducer (i.e., the earphone or "receiver", in hearing aid parlance). Desirably the maximum loudness of the hearing aid signal is reduced by about 1–10 dB below the maximum loudness of the RF signal, and preferably the reduction is in the range of about 3–6 dB (FIG. 10 illustrates a circuit which reduces it by 4 dB).

With this method of signal processing, in a noisy environment as long as the teacher is speaking loud enough to provide maximum loudness in the RF signal, the teacher's voice will be louder than the hearing aid signal in the resultant mixed signal. For best operation, it is desirable that the teacher's microphone and transmitter be provided with automatic gain control (AGC) so that the RF signal will normally be at or nearly at "maximum loudness", whether or not the teacher is speaking with his or her loudest voice.

As shown in FIG. 10, the signal generated by the hearing aid microphone 15 is passed through an automatic gain control preamplifier (AGC PREAMP) and then is sent to the mixer. The RF signal picked up by the antenna and radio receiver (in FIG. 10, identified as the "FM RECEIVER") is also provided to the mixer. The mixer incorporates a mode switch (the physical location of which is depicted in FIG. 1 as element 16) permitting the user to select among three modes of operation—hearing aid only, radio signal only (i.e., "FM ONLY"), or the combined signal with the maximum loudness of the hearing aid signal being reduced relative to the maximum volume of the RF signal (i.e., "FM+(HA @ −4 DB"). The selected signal is then provided to a volume control 18 (the physical location of the volume control can also be seen in FIG. 1) and an audio amplifier, the output of which drives the electro-acoustic transducer (i.e., "receiver" in hearing aid parlance).

While a preferred embodiment of the present invention has been described, it should be understood that various changes, adaptations and modifications may be made therein without departing from the spirit of the invention and the scope of the appended claims.

What is claimed is:

1. A behind-the-ear assistive listening receiver comprising:

a housing having a size and shape adapted to fit behind the outer ear of a user, the housing defining a radially outwardly open cavity at least a substantial portion of which is generally visible to others when the receiver is worn by the user;

two or more crystal carriers removably insertable into the cavity, each such crystal carrier containing an oscillation crystal removable with the crystal carrier and tuned to a particular frequency corresponding to an RF frequency desired to be received by the user and including electrical contacts detachably electrically engageable, without requiring soldering, with complementary contacts carried by the housing when such crystal carrier is inserted into the housing cavity;

an RF receiver disposed substantially within the housing for receiving RF transmissions desired to be received by the user; and a switch for selectively electrically connecting the complementary contacts engaged with one of the oscillation crystals to the RF receiver when the crystal carriers are disposed in the cavity, thereby permitting the receiver to receive the desired RF transmissions on the desired RF frequency.

2. The assistive listening receiver of claim 1 wherein each crystal carrier includes outwardly visible indicia corresponding to the frequency to which such crystal is tuned, such indicia being visible to others when the receiver is worn by the user.

3. The assistive listening receiver of claim 2 wherein the outwardly visible indicia comprises a color corresponding to the frequency to which such crystal is tuned.

4. The assistive listening receiver of claim 1 wherein the opening in the housing is sized to receive two crystal carriers.

5. The assistive listening receiver of claim 4 wherein the crystal carriers are substantially identical in shape.

6. The assistive listening receiver of claim 1 wherein each of the crystal carriers includes an outer surface, at least a portion of which, when installed in the housing, defines an outwardly facing surface at least a portion of which is generally visible to others when the receiver is worn by the user.

7. The assistive listening receiver of claim 1 wherein the RF receiver outputs an electrical RF signal having a maximum loudness, the assistive listening receiver further comprising:

a microphone carried by the housing for converting ambient sounds to an electrical hearing aid signal having a maximum loudness;

an electro-acoustic transducer carried by the housing for converting electrical signals into audible sounds; and a mixer disposed within the housing for mixing the RF signal with the hearing aid signal to provide a mixed output signal to the electro-acoustic transducer, the mixer attenuating the maximum hearing aid signal with respect to the maximum RF signal by about 1 to 10 decibels.

8. The listening receiver of claim 7 wherein the mixer attenuates the maximum hearing aid signal with respect to the maximum RF signal by about 3 to 6 decibels.

9. The listening receiver of claim 7 further comprising a selector switch permitting the user to select among two or more signals to be provided to the electro-acoustic transducer, one of which is the mixed output signal, and one of which is just the RF signal.

10. The listening receiver of claim 7 further comprising a selector switch permitting the user to select among two or more signals to be provided to the electro-acoustic transducer, one of which is the mixed output signal, and one of which is just the hearing aid signal.

11. The listening receiver of claim 7 further comprising a selector switch permitting the user to select among three signals to be provided to the electro-acoustic transducer, one of which is the mixed output signal, one of which is just the hearing aid signal, and one of which is just the RF signal.

12. A behind-the-ear assistive listening receiver comprising:

a housing having a size and shape adapted to fit behind the outer ear of a user, the housing defining a radially outwardly open cavity at least a substantial portion of which is generally visible to others when the receiver is worn by the user;

two or more crystal carriers removably insertable into the cavity, each such crystal carrier containing an oscillation crystal tuned to a particular frequency corresponding to an RF frequency desired to be received by the user, each of the crystal carriers including an outer surface, at least a portion of which, when installed in the housing, defines an outwardly facing surface at least a portion of which is generally visible to others when the receiver is worn by the user, the radially outwardly facing surface of each crystal carrier being generally flush with the adjacent radially outwardly facing surface of the housing;

an RF receiver disposed substantially within the housing for receiving RF transmissions desired to be received by the user; and a switch for selectively electrically connecting one of the oscillation crystals to the RF receiver when the crystal carriers are disposed in the cavity, thereby permitting the receiver to receive the desired RF transmissions on the desired RF frequency.

13. A behind-the-ear assistive listening receiver comprising:

a housing having a size and shape adapted to fit behind the outer ear of a user, the housing having a radially outwardly facing surface positioned so that, when the receiver is worn by the user, the radially outwardly facing surface is generally visible;

the radially outwardly facing surface including an opening into a cavity in the housing;

two substantially identically shaped crystal carriers removably insertable through the opening into the cavity, each such crystal carrier containing an oscillation crystal tuned to a particular frequency corresponding to an RF frequency desired to be received by the user and having outwardly visible color corresponding to the frequency to which such crystal is tuned, such color being visible to others when the receiver is worn by the user;

each of the crystal carriers including an outer surface, at least a portion of which, when installed in the housing, defines an outwardly facing surface at least a portion of which is generally visible to others when the receiver is worn by the user;

an RF receiver disposed substantially within the housing for receiving RF transmissions desired to be received by the user;

each oscillation crystal including electrical contacts detachably electrically engageable, without requiring soldering, with complementary contacts carried by the housing when such crystal is inserted into the housing cavity, such complementary contacts being selectively electrically connectable to the RF receiver when the crystal carriers are disposed in the cavity to permit the receiver to receive the desired RF transmissions on the desired RF frequency.

14. A behind-the-ear assistive listening receiver comprising:

a housing having a size and shape adapted to fit behind the outer ear of a user, the housing defining a radially outwardly open cavity;

an antenna carried by the housing for receiving RF transmissions;

an RF receiver disposed substantially within the housing and being connected to the antenna for receiving and demodulating an RF transmission to produce an electrical radio audio signal having a maximum volume;

two or more crystal carriers removably insertable, without requiring soldering, into the cavity in the housing, each such crystal carrier containing an oscillation crystal tuned to a particular fixed frequency corresponding to a fixed RF frequency desired to be received by the user, at least a portion of each crystal carrier being generally visible to others when the assistive listening receiver is worn by the user;

a switch for selectively connecting one of the oscillation crystals to the RF receiver when the crystal carriers are disposed in the cavity, thereby permitting the receiver to receive the desired RF transmissions on the desired fixed RF frequency;

a microphone carried by the housing for converting ambient sounds to an electrical hearing aid signal which in turn is supplied to an amplifier having automatic gain control for receiving the hearing aid signal and amplifying it to an AGC-controlled maximum loudness;

a mixer disposed within the housing for mixing the radio audio signal with the hearing aid signal to provide a mixed output signal, the mixer attenuating the maximum loudness of the hearing aid signal with respect to the maximum loudness of the radio audio signal by about 1 to 10 decibels;

an amplifier receiving the mixed output signal and providing an amplified mixed output signal; and a transducer connected to the amplifier for converting the amplified mixed output signal to acoustic audio sounds.

15. A behind-the-ear assistive listening receiver comprising:

a housing having a size and shape adapted to fit behind the outer ear of a user;

an antenna carried by the housing for receiving RF transmissions;

an RF receiver disposed substantially within the housing and being connected to the antenna for receiving and demodulating an RF transmission to produce an electrical audio signal;

two or more crystal carriers removably insertable into a cavity in the housing, each such crystal carrier containing an oscillation crystal removable with the crystal carrier and tuned to a particular fixed frequency corresponding to a fixed RF frequency desired to be received by the user and including electrical contacts detachably electrically engageable, without requiring soldering, with complementary contacts carried by the housing when such crystal carrier is inserted into the housing cavity;

a switch for selectively electrically connecting the complementary contacts engaged with one of the oscillation crystals to the RF receiver when the crystal carriers are disposed in the cavity, thereby permitting the receiver to receive the desired RF transmissions on the desired fixed RF frequency;

an amplifier connected to the RF receiver for amplifying the electrical audio signal produced by the RF receiver; and a transducer connected to the amplifier for converting the electrical audio signal to an acoustic audio sound.

16. A behind-the-ear assistive listening receiver comprising:

a housing having a size and shape adapted to fit behind the outer ear of a user, the housing having a radially outwardly facing surface at least a substantial portion of which is generally visible to others when the receiver is worn by the user;

the radially outwardly facing surface including an opening defining a cavity in the housing;

an antenna carried by the housing for receiving RF transmissions;

an RF receiver disposed substantially within the housing and being connected to the antenna for receiving and demodulating an RF transmission to produce an electrical audio signal;

a crystal carrier removably insertable into the cavity in the housing, the crystal carrier containing an oscillation crystal removable with the crystal carrier and tuned to a particular fixed frequency corresponding to a fixed RF frequency desired to be received by the user and including electrical contacts detachably electrically engageable, without requiring soldering, with complementary contacts carried by the housing when such crystal carrier is inserted into the housing cavity, such electrical contacts being electrically connected to the RF receiver when the crystal carrier is disposed in the cavity, thereby permitting the receiver to receive the desired RF transmissions on the desired fixed RF frequency;

the crystal carrier including outwardly visible indicia corresponding to the frequency to which such crystal is tuned, such indicia being visible to others when the receiver is worn by the user;

an amplifier connected to the RF receiver for amplifying the electrical audio signal produced by the RF receiver; and a transducer connected to the amplifier for converting the electrical audio signal to an acoustic audio sound.

17. A behind-the-ear assistive listening receiver comprising:

a housing having a size and shape adapted to fit behind the outer ear of a user, the housing having a radially outwardly oriented surface at least a substantial portion of which is generally visible to others when the receiver is worn by the user;

two or more crystal carriers removably securable to the housing, at least one of the crystal carriers having a radially outwardly oriented surface at least a substantial portion of which is generally visible to others when the crystal carrier is secured to the housing and the receiver is worn by the user, each such crystal carrier containing an oscillation crystal removable with the crystal carrier and tuned to a particular frequency corresponding to an RF frequency desired to be received by the user and including electrical contacts detachably electrically engageable, without requiring soldering, with complementary contacts carried by the housing when such crystal carrier is inserted into the housing cavity;

an RF receiver disposed substantially within the housing for receiving RF transmissions desired to be received by the user; and a switch for selectively electrically connecting the complementary contacts engaged with one of the oscillation crystals to the RF receiver when the crystal carriers are secured to the housing, thereby permitting the receiver to receive the desired RF transmissions on the desired RF frequency.

18. The assistive listening receiver of claim 17 wherein at least one of the crystal carriers is manually removable from the housing without the use of tools.

19. A behind-the-ear assistive listening receiver comprising:

a housing having a size and shape adapted to fit behind the outer ear of a user, the housing having a radially outwardly oriented surface at least a substantial portion of which is generally visible to others when the receiver is worn by the user;

an RF receiver disposed substantially within the housing for receiving RF transmissions desired to be received by the user;

two or more oscillation crystals, each crystal being tuned to a particular frequency corresponding to an RF frequency desired to be received by the user;

at least one crystal carrier removably securable to the housing, the crystal carrier having a radially outwardly oriented surface at least a substantial portion of which is generally visible to others when the crystal carrier is secured to the housing and the receiver is worn by the user, one of the oscillation crystals being contained within and removable with such crystal carrier and including electrical contacts detachably electrically engageable, without requiring soldering, with complementary contacts carried by the housing when such crystal carrier is inserted into the housing cavity; and a switch for selectively electrically connecting one of the oscillation crystals to the RF receiver, thereby permitting the receiver to receive the desired RF transmissions on the desired RF frequency.

* * * * *